US005511635A

United States Patent [19]

Kameli

[11] Patent Number: 5,511,635

[45] **Date of Patent: *Apr. 30, 1996**

[54] FLOOR POPULATION DETECTION FOR AN ELEVATOR SYSTEM

[75] Inventor: Nader Kameli, New Britain, Conn.

[73] Assignee: Otis Elevator Company, Farmington, Conn.

[ * ] Notice: The term of this patent shall not extend beyond the expiration date of Pat. No. 5,276,295.

[21] Appl. No.: 280,562

[22] Filed: Jul. 25, 1994

Related U.S. Application Data

[63] Continuation of Ser. No. 580,887, Sep. 11, 1990, abandoned.

[51] Int. Cl.[6] ..... B66B 1/28

[52] U.S. Cl. ..... 187/392; 187/383

[58] Field of Search ..... 187/392, 382, 187/385, 383, 387

[56] References Cited

U.S. PATENT DOCUMENTS

| | | | |
|---|---|---|---|
| 3,561,571 | 2/1971 | Gingrich | 187/127 |
| 4,044,860 | 10/1971 | Kaneko et al. | 187/132 |
| 4,553,639 | 11/1985 | Uetani | 187/131 |
| 4,562,530 | 12/1985 | Umeoa et al. | 187/100 |
| 4,672,531 | 6/1987 | Uetani | 181/124 |
| 4,846,311 | 7/1989 | Thangavelu | 187/125 |
| 4,874,063 | 10/1989 | Taylor | 187/131 X |
| 4,924,416 | 5/1990 | Sasao | 187/131 X |
| 4,939,634 | 7/1990 | Schroder | 187/131 X |
| 5,022,497 | 6/1991 | Thangavelu | 187/124 |
| 5,024,296 | 6/1991 | Kameli | 187/132 |
| 5,035,302 | 7/1991 | Thangavelu | 187/125 |
| 5,272,288 | 12/1993 | Kameli | 187/127 |
| 5,276,295 | 1/1994 | Kameli | 187/132 |

*Primary Examiner*—Peter S. Wong
*Assistant Examiner*—Robert Nappi

[57] ABSTRACT

A computer controlled elevator system (FIG. 1) including signal processing means for dynamically computing the population spread of the building, i.e., the number of elevator users in a building on a floor-by-floor basis, including the lobby, in accordance with an algorithm (FIG. 2). During the up-peak period each floor's population is computed by monitoring the boarding and de-boarding counts and using those counts to update that floor's population figure throughout that period on an additive basis. After the period has been completed, the floor-by-floor information, which had been maintained in a table, is used to determine the "final" historic based floor population spread using also historic data based at least on the past several active days' of population spread using "exponential smoothing." As a verifying cross-check the lobby's figure, which typically should equal the total building population, is compared to the total of all of the upper floors' populations. The historically based derivation of the floor population is recorded and made available for use in other signal processing functions in the system, such as, for example, prediction methodology for dynamic channeling of the elevator cars, stored in a table for that current day's information.

5 Claims, 2 Drawing Sheets

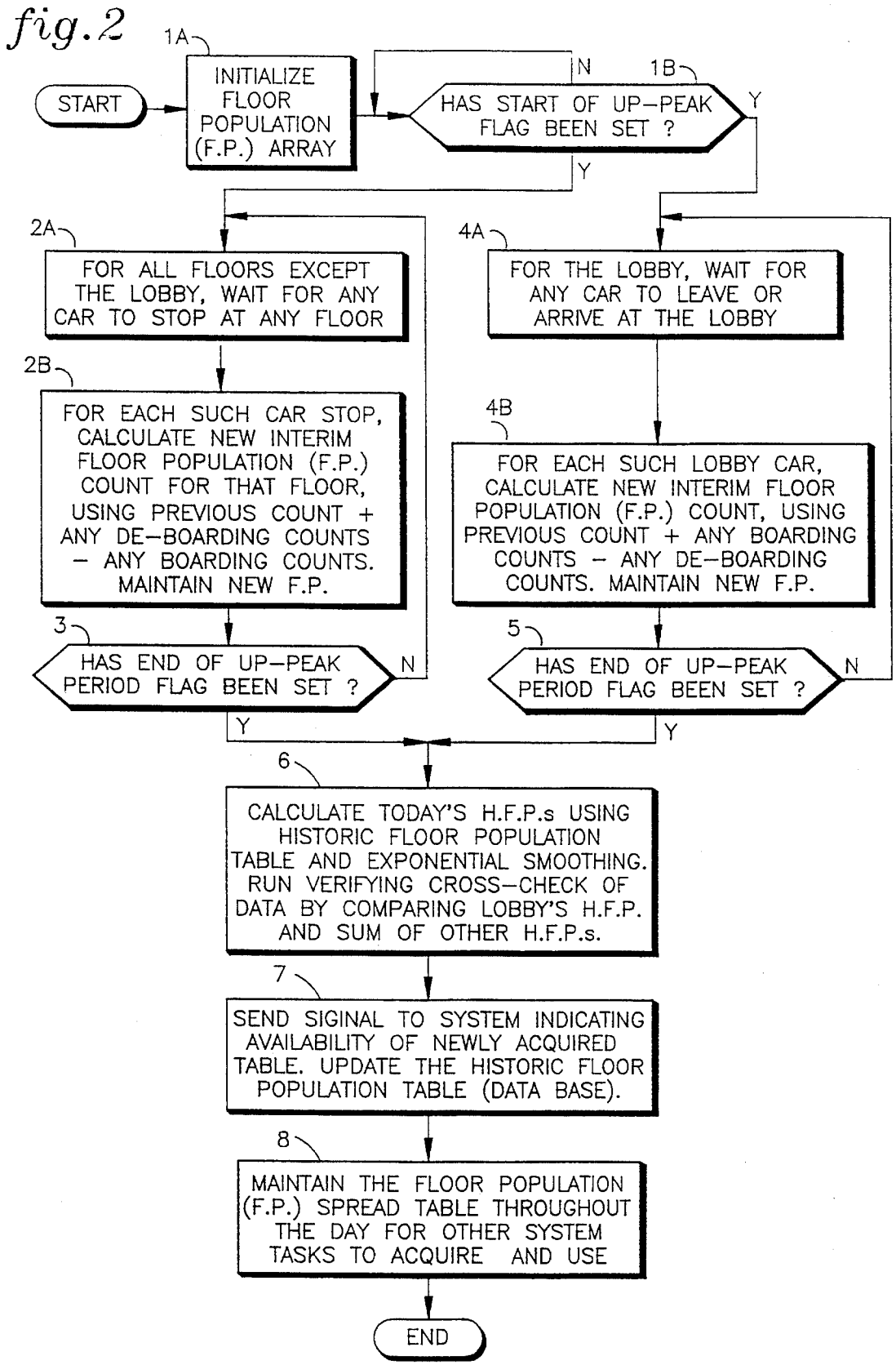
fig.2
START
1A
INITIALIZE FLOOR POPULATION (F.P.) ARRAY
1B
HAS START OF UP-PEAK FLAG BEEN SET ?
N
Y
2A
FOR ALL FLOORS EXCEPT THE LOBBY, WAIT FOR ANY CAR TO STOP AT ANY FLOOR
2B
FOR EACH SUCH CAR STOP, CALCULATE NEW INTERIM FLOOR POPULATION (F.P.) COUNT FOR THAT FLOOR, USING PREVIOUS COUNT + ANY DE-BOARDING COUNTS - ANY BOARDING COUNTS. MAINTAIN NEW F.P.
3
HAS END OF UP-PEAK PERIOD FLAG BEEN SET ?
4A
FOR THE LOBBY, WAIT FOR ANY CAR TO LEAVE OR ARRIVE AT THE LOBBY
4B
FOR EACH SUCH LOBBY CAR, CALCULATE NEW INTERIM FLOOR POPULATION (F.P.) COUNT, USING PREVIOUS COUNT + ANY BOARDING COUNTS - ANY DE-BOARDING COUNTS. MAINTAIN NEW F.P.
5
HAS END OF UP-PEAK PERIOD FLAG BEEN SET ?
6
CALCULATE TODAY'S H.F.P.s USING HISTORIC FLOOR POPULATION TABLE AND EXPONENTIAL SMOOTHING. RUN VERIFYING CROSS-CHECK OF DATA BY COMPARING LOBBY'S H.F.P. AND SUM OF OTHER H.F.P.s.
7
SEND SIGINAL TO SYSTEM INDICATING AVAILABILITY OF NEWLY ACQUIRED TABLE. UPDATE THE HISTORIC FLOOR POPULATION TABLE (DATA BASE).
8
MAINTAIN THE FLOOR POPULATION (F.P.) SPREAD TABLE THROUGHOUT THE DAY FOR OTHER SYSTEM TASKS TO ACQUIRE AND USE
END

FLOOR POPULATION DETECTION FOR AN ELEVATOR SYSTEM

This is a continuation of application Ser. No. 07/580,887, filed on Sep. 11, 1990, now abandoned.

REFERENCE TO RELATED APPLICATIONS

This application relates to some of the same subject matter as the following U.S. Patents, all of which were based on applications co-pending herewith, which show the state of the art and systems with which the present invention may be used: U.S. Pat. Nos. 5,272,288, 5,024,296, 5,276,295, 5,022,497 and 5,035,302.

TECHNICAL FIELD

The present invention relates to elevator systems, and more particularly to elevator systems which generate operational data, such as, for example, passenger boarding and de-boarding counts, for use in making predictions of future conditions and events, which predictions can be used, for example, as guides to assign cars to desired locations or roles in the system. Even more particularly, the present invention relates to techniques and methodology for dynamically providing current, as well as historic, information of the building population on a floor-by-floor basis, which information can then be made available for other uses in the system, including, for example, the elevator system's prediction methodology.

BACKGROUND ART

In the process of forecasting behavior to optimize the performance of the cars in any transportation system (horizontal or vertical), there are many pieces of information necessary concerning the system that should be obtained. The acquisition of detailed information helps the system in fine tuning its optimization based on this extended knowledge.

One piece of information that can be important to the evaluation or prediction of any building behavior is the building's population spread, that is, how many elevator users are present on a floor-by-floor basis in the building. One can easily understand that an executive floor with a population of, for example, ten (10) people would have a smaller demand for elevator service than would a restaurant floor with a population of, for example, two hundred (200) people.

This shows the need for acquiring the population density of the building on a floor-by-floor basis. Knowing this information provides the system with the ability to decide when the floor is full, empty, moderately full, etc. The availability of this information or knowledge permits the system to make corrective or more accurate decisions based on, for example, historically predicted values.

It is believed that, prior to the present invention, there has been no system or procedure that dynamically evaluated the population density of a building. If population was used, it typically was a hard-coded table that was not changed or updated by the system itself. Should any alteration be required, the user or system maintainer had to physically change the numbers, i.e., re-program the numbers, to provide the best "guesstimate" of the values. Such an operationally static system is not as desirable as a dynamic one, which provides updated, accurate information on a "real time" on-going basis within the system itself.

DISCLOSURE OF INVENTION

The present invention thus originated from the need to improve elevator service time for a building by providing current, up-to-date information of the building population on the system on a floor-by-floor basis, which information could then be made available for other uses in the system, including, for example, the system's prediction methodology in which, for example, the elevator cars are assigned to various floors based on predicted future elevator needs at those floors.

In the exemplary algorithm of the invention building population information is developed on a floor-by-floor basis preferably during the "up-peak" operational period of the system. However, if so desired, aspects of the building population calculations of the invention could be implemented during the "down-peak" period, but at least part (preferably all) should be done during up-peak, so that the most current information is then available during that day's operation of the elevator system.

"Up-peak" duration may be defined as that period of morning time, when the building is not significantly populated before that period and will be substantially populated, namely over, for example, ninety-five (95%) percent populated, after that period.

In accordance with the preferred embodiment of the invention, during the up-peak period, a set of floor population related variables are maintained for the building. These variables typically are arranged in an array, and individual floor numbers preferably are used as the index into the array.

Prior to the "up-peak" period for each morning, the array is initialized to zero. During the course of "up-peak", this array is built up and maintained.

Upon the arrival of any and every car to any floor other than the lobby, the floor population count (initially zero) is continuously modified for that floor by adding in the number of people which de-boarded to the floor and subtracting the number of people which boarded the car on that floor. Thus $$F.P._{n(c)}=F.P._{n(c-1)}+D.C._{n(c)}-B.C._{n(c)}$$

where $F.P._{n(c)}$ is the current floor population being calculated after that car stop "c" is completed;

$F.P._{n(c-1)}$ is the previous floor population count prior to that car stop "c", i.e., the floor population calculated for car stop "c−1";

$D.C._{n(c)}$ is the de-boarding count for the car stop "c"; and $B.D._{n(c)}$ is the boarding count for the car stop "c";

while

"c" is the particular car stop involved associated with the calculation then being made of the floor population; and "n" is the number of the building floor involved.

As an alternative to instantaneously evaluating every car stop and updating the interim floor population count every time a car arrives at any floor, the updating could be done on a time-interval-by-time-interval basis, i.e., for example, every few minutes (depending upon the interval being used by the system) using the de-boarding and boarding counts generated in other parts of the system on such a basis, as described more fully in the applications referred to above. In that case the "interval" formula would be as follows:

$$F.P._{n(t)}=F.P._{n(t-1)}+D.C._{n(t)}-B.C._{n(t)}$$

where $F.P._{n(t)}$ is the current floor population being calculated for the current interval "t";

$F.P._{n(t-1)}$ is the previous floor population count, i.e., the previously calculated floor population for interval "t–1";

$D.C._{n(t)}$ is the de-boarding count for interval "t"; and $B.D._{n(t)}$ is the boarding count for interval "t";

while

"t" is the particular time interval number associated with the calculation then being made of the floor population; and "n" is the number of the building floor involved.

In either case the interim floor population array is updated after each calculation and continuously maintained for all of the floors until the end of the "up-peak" period.

Preferably promptly upon the end of the "up-peak" period (or sometime thereafter), this value is compared against the previous historic value (gathered on the previous days) for the floor population. Today's count for the floor's population is then preferably incorporated into the overall historic count by the following "exponential smoothing" relationship:

$$H.F.P._{n(d)}=a*F.P._{n(d)}+(1-a)*H.F.P._{n(d-1)}$$

where $H.F.P._n$ is the currently determined or calculated historic floor population for floor "n" for that day "d";

$F.P._n$ is that floor's currently determined or calculated floor population for that day; &

$H.F.P._{n(d-1)}$ is that floor's previously determined historic floor population, i.e., the historic floor population as it stood or had been calculated as of the previous day (d–1); and where "a" is the weight to be given to the first component, namely today's data, with the sum of the two components being unity. The value of this weighing factor "a" effectively decides and mathematically determines the length of time before a shift in population is totally incorporated.

For example, if the floor has had a population of one hundred and twenty (120) people for the past few weeks and suddenly a population of, for example, one hundred and fifty (150) is encountered, it could be possible that this number is either wrong or is due to a temporary shift in population resulting from, for example, visitors. Therefore, immediately replacing the "120" with the observed "150" would produce an error on the subsequent day.

A value of, for example, two-tenths (0.2) for "a" indicates and provides a gradual shift from "120" to "150", should the population shift persist. If the population remains at "150" for the next six (6) days or so, the historic population will reflect it. On the other hand, if the shift was only temporary in fact, then with the use of the weighted formula the next day would have a value of "126," which is much closer to the actual "120" than would be the "150."

This method preferably is practiced for every floor in the building, including the lobby, with changes to the methodology due to the special nature of the lobby in the typical office building floor. The count achieved for the lobby usually represents the total building population, as most buildings have only one entry level floor, namely the "lobby," and in most office buildings, all tenants leave the building at the end of their work day and come back into the building during the up-peak period.

However, it is noted that the formula used for the lobby calculation has its additive factors switched, namely, its calculated, current floor (viz. the building) population equals the previous count, plus the current boarding count minus the current de-boarding count. This is because the direction of flow of the traffic at the lobby is just the opposite to the other floors, namely, during up-peak most, if not all, of the traffic at the lobby is going into the cars (boarding), while at the other floors most, if not all, of the traffic is getting off at the floors (de-boarding).

As a verifying cross-check between the calculated floor populations of the upper floors and the building population calculated at the lobby floor, the total building population generated by adding up each floor's individual population is preferably compared against the building population calculated at the lobby floor.

It should be noted that absolute precision in the dynamically derived floor population spread is not essential and that a good, reasonably accurate approximation is sufficient.

Ultimately, the table of building population counts produced by this task is then fed into other tasks, such as, for example, prediction error correction, significant traffic density data filtering, or dynamic channeling, etc., as a partial input for those subsequent data processing methodologies.

Thus, in summary, in the preferred, exemplary embodiment, the task of initially calculating each floor's population has the following inputs:

(a) on-going, continuous traffic counts in the form of people boarding and people de-boarding for each floor in the building;

(b) a signal indicative of the start of up-peak period;

(c) a signal indicative of the end of the up-peak period; and (d) historic floor population knowledge accumulated up to the previous day;

while the task has the following outputs:

(a) a table of data representing the building's population distribution pattern;

(b) a signal to the calling task(s) indicating the availability of the table;

(c) a signal to the historic task(s) indicating the updated table of population; and (d) the historic floor population table.

Thus, the approach of the invention helps to provide better service for the elevator system than would otherwise have been achieved by elevator cars being assigned without the benefit of accurate, currently available building and floor population data on a floor-by-floor basis.

The invention may be practiced in a wide variety of elevator systems, utilizing known technology, in the light of the teachings of the invention, which are discussed above and below in some further detail.

Other features and advantages will be apparent from the specification and claims and from the accompanying drawings, which illustrate an exemplary embodiment of the invention.

BRIEF DESCRIPTION OF DRAWINGS

FIG. 2 is a simplified, logic flow chart or diagram of an exemplary methodology used in separating out the "significant traffic density" data in accordance with the invention.

BEST MODE

First Exemplary Elevator Application

Figure 1:
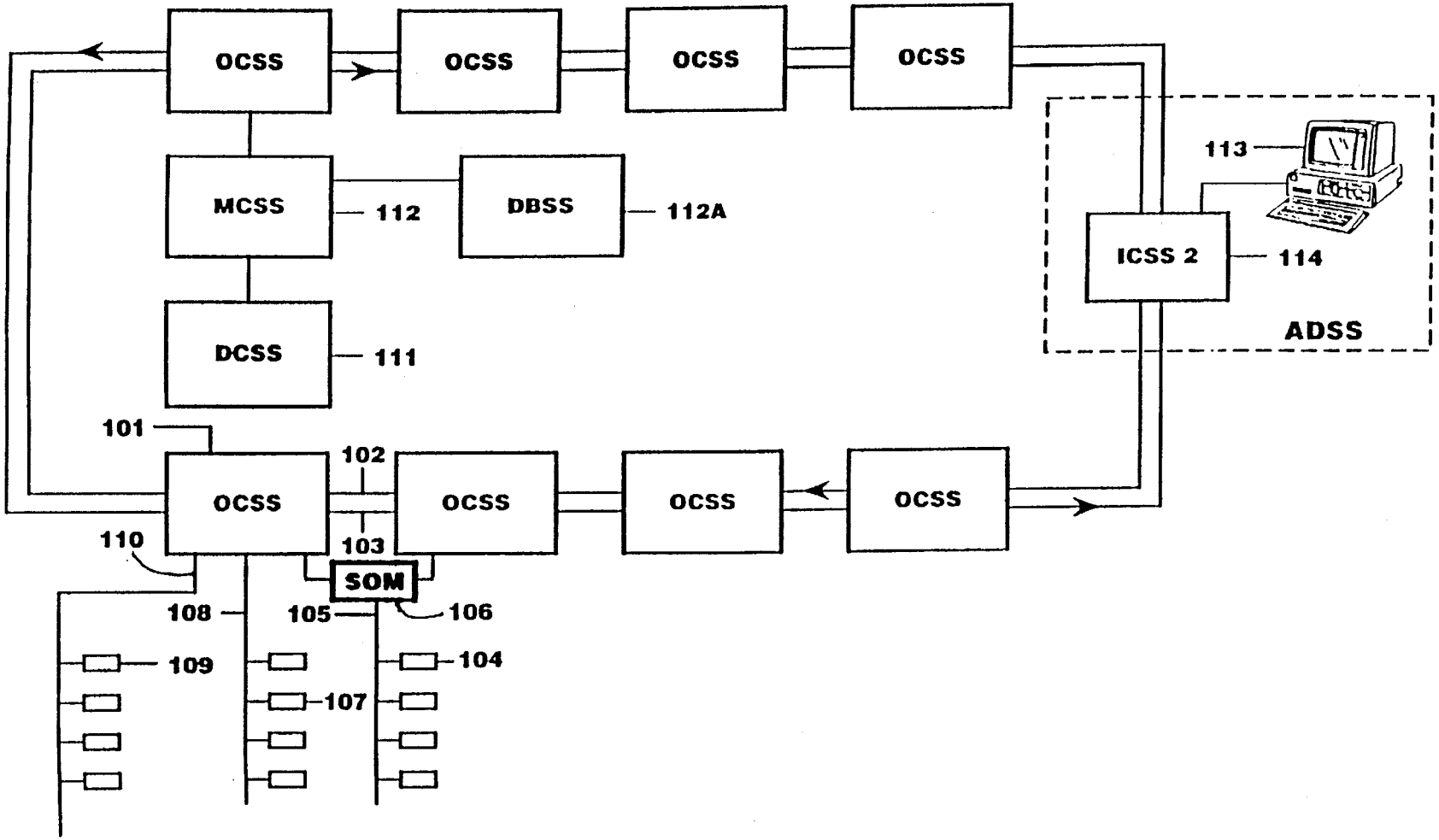
FIG. 1 PRIOR ART
FIG. 1 is a simplified, schematic block diagram of an exemplary ring communication system for elevator group control employed in connection with the elevator car elements of an elevator system and in which the invention may be implemented in connection with the advanced dispatcher subsystem (ADSS) and the cars' individual operational control subsystems (OCSS) and their related subsystems.

For the purposes of detailing a first, exemplary elevator system, reference is had to the disclosures of U.S. Pat. No. 4,330,836 entitled "Elevator Cab Load Measuring System"

of Donofrio & Games issued May 18, 1982, U.S. Pat. No. 4,363,381 of Bittar entitled "Relative System Response Elevator Car Assignments" (issued Dec. 14, 1982) and Bittar's subsequent U.S. Pat. No. 4,815,568 entitled "Weighted Relative System Response Elevator Car Assignment With Variable Bonuses and Penalties" (issued Mar. 28, 1989), the disclosures of which are incorporated herein by reference, supplemented by U.S. application Ser. No. 07/318,307 of Kandasamy Thangavelu entitled "Relative System Response Elevator Dispatcher System Using 'Artificial Intelligence' to Vary Bonuses and Penalties" (filed Mar. 3, 1989) now U.S. Pat. No. 5,024,295.

One application for the present invention is in an elevator control system employing microprocessor-based group and car controllers using signal processing means, which through generated signals communicates with the cars of the elevator system to determine the conditions of the cars and responds to, for example, hall calls registered at a plurality of landings in the building serviced by the cars under the control of the group and car controllers, to provide, for example, assignments of the hall calls to the cars. An exemplary elevator system with an exemplary group controller and associated car controllers (in block diagram form) are illustrated in FIGS. 1 & 2, respectively, of the '381 patent and described in detail therein, as well as in some of the related applications referred to above.

The makeup of micro-computer systems, such as may be used in the implementation of the elevator car controllers, the group controller, and the cab controllers can be selected from readily available components or families thereof, in accordance with known technology as described in various commercial and technical publications. The microcomputer for the group controller typically will have appropriate input and output (I/O) channels, an appropriate address, data & control bus and sufficient random access memory (RAM) and appropriate read-only memory (ROM), as well as other associated circuitry, as is well known to those of skill in the art. The software structures for implementing the present invention, and the peripheral features which are disclosed herein, may be organized in a wide variety of fashions.

Additionally, for further example, the invention could be implemented in connection with the advanced dispatcher subsystem (ADSS) and the operational control subsystems (OCSSs) and their related subsystems of the ring communication system of FIG. 1 hereof as described below.

Exemplary Ring System (FIG. 1)

As a variant to the group controller elements of the system generally described above and as a more current application, in certain elevator systems, as described in co-pending application Ser. No. 07/029,495, entitled "Two-Way Ring Communication System for Elevator Group Control" (filed Mar. 23, 1987), now U.S. Pat. No. 5,202,540, the elevator group control may be distributed to separate microprocessors, one per car. These microprocessors, known as operational control subsystems (OCSS) 101, are all connected together in a two-way ring communication (102, 103). Each OCSS 101 has a number of other subsystems and signaling devices, etc., associated with it, as will be described more filly below, but basically only one such collection of subsystems and signaling devices is illustrated in FIG. 1 for the sake of simplicity.

The hall buttons and lights are connected with remote stations 104 and remote serial communication links 105 to the OCSS 101 via a switch-over module 106. The car buttons, lights and switches are connected through similar remote stations 107 and serial links 108 to the OCSS 101. The car specific hall features, such as car direction and position indicators, are connected through remote stations 109 and remote serial link 110 to the OCSS 101.

The car load measurement is periodically read by the door control subsystem (DCSS) 111, which is part of the car controller. This load is sent to the motion control subsystem. (MCSS) 112, which is also part of the car controller. This load in turn is sent to the OCSS 101. DCSS 111 and MCSS 112 are micro-processors controlling door operation and car motion under the control of the OCSS 101, with the MCSS 112 working in conjunction with the drive & brake subsystem (DBSS) 112A.

The dispatching function is executed by the OCSS 101, under the control of the advanced dispatcher subsystem (ADSS) 113, which communicates with the OCSS 101 via the information control subsystem (ICSS) 114. The car load measured may be converted into boarding and de-boarding passenger counts using the average weight of a passenger by the MCSS 112 and sent to the OCSS 101. The OCSS sends this data to the ADSS 113 via ICSS 114.

The ADSS 113 through signal processing inter alia collects the passenger boarding and de-boarding counts at the various floors and car arrival and departure counts, so that, in accordance with its programming, it can analyze the traffic conditions at each floor, as described below. The ADSS 113 can also collect other data for use in making predictions, etc., if so desired.

For further background information reference is also had to the magazine article entitled "Intelligent Elevator Dispatching Systems" of Nader Kameli & Kandasamy Thangavelu (*AI Expert*, Sept. 1989; pp. 32– 37), the disclosure of which is also incorporated herein by reference.

Owing to the computing capability of the "CPUs," the system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and floor traffic may also be analyzed through signals from each car that indicate each car's load. Alternatively, passenger sensors, which sense the number of passengers passing through each elevator's doors, using for example, infra-red sensors, can be used to get car boarding and de-boarding counts for car stop at floors other than the lobby and for each combined car arrival and departure at the lobby.

Using such data and correlating it with the floor involved and, if so desired, the time of day and preferably the day of the week, a meaningful, historically based, building and floor population or traffic measures can be obtained on a floor-by-floor basis based on boarding and de-boarding counts by using signal processing routines that implement the sequences described in, for example, the flow chart of FIG. 2, described more fully below.

Exemplary Calculation of Floor & Building Population (FIG. 2)

As generally illustrated in FIG. 2, the exemplary logic of the present invention includes the sequences described below. In the embodiment of FIG. 2, building population information is developed on a floor-by-floor basis during the "up-peak" operational period of the system.

The concept of an "up-peak" period is well established in the art. The start and end of up-peak periods can be dynamically set by the system, using, for example, the disclosure of the aforementioned U.S. Pat. No. 5,035,302.

During the up-peak period, a set of floor population related variables are maintained for the building. These variables are arranged in an array, and individual floor numbers are used as the index into the array. In step 1A of FIG. 2 the floor population array is initialized to zero values for each of the floors of the building, and in step 1B the algorithm waits for the beginning of the "up-peak" period.

During the course of "up-peak", the array is to be built up and maintained in, for example, working memory (RAM).

With respect to floors other than the lobby, in steps 2A & 2B, upon the arrival of any and every car to a floor, the interim floor population count (F.P.; initially zero) for that floor is continuously modified and updated by adding to the previous figure for the count the number of people which de-boarded to the floor and subtracting the number of people which boarded the car on that floor, based, for example, on the following formula:

$$F.P._{n(c)}=F.P._{n(c-1)}+D.C._{n(c)}-B.C._{n(c)}$$

where $F.P._{n(c)}$ is the current floor population being calculated after that car stop "c" is completed;

$F.P._{n(c-1)}$ is the previous floor population count prior to that car stop "c", i.e., the floor population calculated for car stop "c−1";

$D.C._{n(c)}$ is the de-boarding; count for the car stop "c"; and $B.D._{n(c)}$ is the boarding count for the car stop "c";

while

"c" is the particular car stop involved associated with the calculation then being made of the floor population; and "n" is the number of the building floor involved.

Alternatively, as noted above, rather than on an instantaneous car-stop-by-car-stop basis, a time interval-by-interval basis could be used.

The interim floor population array for all of the floors other than the lobby is thus updated on a continuous basis until the end of the "up-peak" period is detected in step 3, with the end of the period preferably being decided and noted by the system itself, which sets the "END" of up-peak flag "ON".

With respect to the lobby, in steps 4A & 4B, upon the arrival and the leaving of any and every car at the lobby, the interim floor population count (F.P.; initially zero) for the building, determined at the lobby (referred to as "lobby population" herein), is continuously modified and updated by adding to the previous figure for the count the number of people which boarded and subtracting the number of people which de-boarded based, for example, on the following formula:

$$F.P._{lobby(c)}=F.P._{lobby(c-1)}+B.C._{lobby(c)}-D.C._{lobby(c)}$$

where $F.P._{lobby(c)}$ is the current, interim lobby population;

$F.P._{lobby(c-1)}$ is the previous, interim lobby population count;

$D.C._{lobby(c)}$ is the de-boarding count for the arriving and then leaving car; and $B.D._{lobby(c)}$ is the boarding count for the arriving and then leaving car;

while

"c" is the "arriving and then leaving" car involved associated with the calculation then being made of the floor population.

Alternatively, as alluded to above, rather than on an instantaneous car-by-car basis, a time interval-by-interval basis could be used.

The interim floor population array for the lobby is thus updated on a continuous basis until the end of the "up-peak" period is detected in step 5, with the end of the period preferably being decided and noted by the system itself, which sets the "END" of the up-peak flag "ON".

Once out of the "up-peak" period, each floor's value is individually compared against the previous value for that floor based on the information of the previous days, for example, the previous ten (10) days. Today's count for the floor's population is then incorporated into the overall count using, for example, the following "exponential smoothing" formula:

$$H.F.P._{n(d)}=a*F.P._{n(d)}+(1-a)*H.F.P._{n(d-1)}$$

where $H.F.P._{n(d)}$ is the currently determined or calculated historic floor population for floor "n" for the current day "d";

$F.P._{n(d)}$ is that floor's currently determined or calculated floor population for that day from the up-peak period completion of steps 2–5; &

$H.F.P._{n(d-1)}$ is fiat floor's previously determined historic floor population, i.e., the historic floor population as it stood or had been calculated as of the previous day "d−1" based, for example, on a number of historically recorded preceding days, such as, for example, the past five (5) or the last (10) days; and where "a" is the weight to be given to the first component, namely today's data, and "1−a" being the weight given to the second component, namely, yesterday's data, the sum of the weights of the two components being unity; that is, "a" is a numerical weighing factor having a value less than "one" (1) but greater than zero.

As noted above, the value of this weighing factor "a" effectively decides and mathematically determines the length of time before a shift in population is totally incorporated. An exemplary value of, for example, two-tenths (0.2) for "a" provides a gradual shift for any day-to-day population changes. Other values could also be used, depending on the desired rate of incorporating into the final calculation any floor traffic shifts.

This methodology is practiced for every floor in the building, including the lobby (note steps 4–5). However, as noted and detailed above, the formula used for the lobby calculation has its additive factors switched, namely, its calculated, current floor (viz. building) population is the previous count, plus the current boarding count, minus the current de-boarding count.

In step 6, as a verifying cross-check between the calculated floor populations of the upper floors and the calculated lobby's floor (building) population, the total building population generated by adding up each floor's individual population is compared against the lobby's floor population, assuming the building is of the appropriate type, to see, for example, if there is any deviation that should not be accepted.

For example, if the summed-up measure is greater than at least ninety-five percent (95%) of the calculated lobby measure, but no more than one hundred and five (105%), i.e.

$$\sum_{n=2}^{n} F.P._n = F.P._{lobby} \pm 5\%$$

then any such deviations typically would be acceptable. If greater deviation is present, then that might represent a significant problem, which preferably is at least noted;, if not evaluated and possibly corrected. Thus, as to the latter, for example, the data could be further processed by comparing the data to historic data and possibly filtering out or otherwise changing individual figures having exceptionally large deviations from previously set norms, etc.

Once any verification (and correction procedures) are completed, in step 7 a signal is sent to the system indicating the availability of the newly acquired table of counted and processed floor population data on a floor-by-floor basis. Thus, the table of counts produced by this task is made available to be fed into other tasks, such as, for example, prediction error correction, traffic data filtering, or dynamic channeling, etc., as a partial input for those subsequent data processing methodologies. Note, for examples of these further methodologies, the above referenced U.S. Pat. Nos. 5,276,295 and 5,024,296.

Additionally, in step 7 today's calculated historic floor population figures for each floor is also copied to the historic floor population data base for use in, for example, subsequent days' calculations, with such data base being indexed by the floor numbers. The data base includes preferably at least several immediately past, active days, with active days in a typical office building including Monday through Friday and for some buildings Saturdays.

In step 8 the table is maintained in, for example, working memory (RAM) throughout the day for other system tasks to acquire and use, as may be desired, and thereafter the process is ended.

Thus, in summary, the task of calculating each floor's population, which takes place in ADSS 113, has the following inputs:

(a) on-going, continuous traffic counts in the form of people boarding and people de-boarding for each floor in the building coming from the OCSSs 101 using, e.g., weight load calculations or infra-red passenger sensors, or taken from data stored on the hard disk of the ADSS's microcomputer 113, which was just generated and collected (steps 2A & 2B);

(b) a signal indicative of the start of up-peak period, typically from another task being run in the ADSS (step 1B);

(c) and a signal indicative of the end of the up-peak period, typically from another task being run in the ADSS (steps 3 & 5); and (d) historic floor population knowledge accumulated up to the previous day (step 6);

while the task has the following outputs:

(a) a table of interim data representing the building's population distribution pattern indexed by floor number, which is maintained in working memory (RAM) in the ADSS's microcomputer 113 (step 8);

(b) a signal to the calling task(s) being run in the ADSS indicating the availability of the table (step 7);

(c) a signal to the historic task(s) being run in the ADSS indicating the availability of the updated table of population (step 7); and (d) the historic floor population table in data base fore indexed by floor number, which is stored on the hard disk of the ADSS's microcomputer 113 (step 7).

Although this invention has been shown and described with respect to at least one detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

I claim:

1. A method of dispatching a plurality of elevator cars serving a plurality of floors of a building having a lobby floor, comprising:

during an interval of time, determining at each stop that each elevator car makes at each of said floors other than said lobby floor a first number of passengers that board the car and providing a first signal indicative thereof, and determining a second number of passengers that de-board the car and providing a second signal indicative thereof;

providing, in response to said first and second signals, an indication of a third number of passengers currently on the floor associated with each of said stops and providing a plurality of corresponding upper floor population signals indicative thereof, said third number increasing for each passenger that de-boards one of said cars and said third number decreasing for each passenger that boards one of said cars; and dispatching said elevator cars to provide service to said floors in response to a process which utilizes said plurality of upper floor population signals.

2. A method according to claim 1 further comprising:

during said interval of time, determining for each stop that each of said cars makes at said lobby floor, a fourth number of passengers that board the car and providing a fourth signal indicative thereof, and determining a fifth number of passengers that de-board the car and providing a fifth signal indicative thereof;

providing in response to said fourth and fifth signals, an indication of total number of passengers in said building and providing a lobby population signal indicative thereof, said total number increasing for each passenger that boards one of said cars and said total number decreasing for each passenger that de-boards one of said cars;

summing the number of passengers indicated by all of said upper floor population signals to provide a summation signal;

comparing the number of passengers indicated by said summation signal with the number of passengers indicated by said lobby population signal; and in response to said numbers differing by more than a threshold magnitude, altering the number indicated by one of said upper floor population signals.

3. A method according to claim 1 further comprising:

determining when a morning up-peak traffic pattern begins in said building and providing a start-of-up-peak signal indicative thereof;

determining when a morning up-peak traffic pattern ends in said building and providing an end-of-up-peak signal indicative thereof;

initiating said interval of time in response to said start-of-up-peak signal; and terminating said interval of time in response to said end-of-up-peak signal.

4. A method according to claim 1 wherein said dispatching step comprises:

storing each of said upper floor population signals related to said interval of time, a given number of business days; and combining said upper floor population signal provided during a given interval of time in a current business day for each floor with the upper floor population signals provided during a like interval of time in said given number of preceding business days for each said floor to provide a corresponding historical floor population signal for each said floor; and dispatching said cars in a process which utilizes said historical floor population signals.

5. A method according to claim 4 further comprising:

during said interval of time, determining for each stop that each of said cars makes at said lobby floor, a fourth number of passengers that board the car and providing a fourth signal indicative thereof, and determining a fifth number of passengers that de-board the car and providing a fifth signal indicative thereof;

providing in response to said fourth and fifth signals, an indication of total number of passengers in said building and providing a lobby population signal indicative thereof, said total number increasing for each passenger that boards one of said cars and said total number decreasing for each passenger that de-boards one of said cars;

summing the number of passengers indicated by all of said upper floor population signals to provide a summation signal;

comparing the number of passengers indicated by said summation signal with the number of passengers indicated by said lobby population signal; and in response to said summation signal number differing by more than a threshold magnitude from said lobby population signal number, altering the number indicated by one of said upper floor population signals which differs significantly from the corresponding one of said historical floor signals.

* * * * *